United States Patent [19]

Tissot et al.

[11] 4,398,519

[45] Aug. 16, 1983

[54] FUEL INJECTION APPARATUS FOR INTERNAL COMBUSTION ENGINES, IN PARTICULAR FOR DIESEL ENGINES

[75] Inventors: Raymond Tissot, Genas; Jean Leblanc, Lyons; Jean Pigeroulet, Villeurbanne, all of France

[73] Assignee: Robert-Bosch GmbH, Stuttgart, Fed. Rep. of Germany

[21] Appl. No.: 276,747

[22] Filed: Jun. 24, 1981

[30] Foreign Application Priority Data

Jul. 2, 1980 [DE] Fed. Rep. of Germany ..... 3024963

[51] Int. Cl.[3] ..... F02M 39/00

[52] U.S. Cl. ..... 123/446; 123/449; 123/459

[58] Field of Search ..... 123/446, 449, 459, 460

[56] References Cited

U.S. PATENT DOCUMENTS

| | | | |
|---|---|---|---|
| 3,011,489 | 12/1961 | Bessiere | 123/446 |
| 3,358,662 | 12/1967 | Kulke | 123/449 |
| 3,404,668 | 10/1968 | Eheim et al. | 123/449 |
| 3,620,647 | 11/1971 | Hofer et al. | 123/446 |
| 3,667,438 | 6/1972 | Moulin et al. | 123/447 |
| 3,699,939 | 10/1972 | Eckert et al. | 123/459 |
| 3,921,604 | 11/1975 | Links | 123/458 |
| 4,249,497 | 2/1981 | Eheim et al. | 123/467 |

*Primary Examiner*—Ira S. Lazarus
*Assistant Examiner*—Magdalen Moy
*Attorney, Agent, or Firm*—Edwin E. Greigg

[57] ABSTRACT

A fuel injection apparatus for internal combustion engines is proposed in which the onset and end of injection are determined by a hydraulically actuated control slide. The injection pumps of the apparatus, which are preferably combined with an injection nozzle to make a pump/nozzle unit have a central control pressure pump supplied with fuel by a supply pump. The control pressure pump creates a control pressure ($p_S$) which is a multiple increase in comparison to the supply pressure ($p_V$) of the supply pump and actuates the control slide. Each control slide is placed under control pressure ($p_S$) to initiate the onset of injection via a control line which is separated from the filling lines of the injection pump and closes an overflow channel which leads away from the pump work chamber. At the end of injection the control slide again relieves this overflow channel to a supply line during its return stroke.

8 Claims, 4 Drawing Figures

FUEL INJECTION APPARATUS FOR INTERNAL COMBUSTION ENGINES, IN PARTICULAR FOR DIESEL ENGINES

BACKGROUND OF THE INVENTION

The invention is directed to improvements in fuel injection apparatus for diesel engines. A fuel injection apparatus of this type is already known (U.S. Pat. No. 3,465,737), in which the injection pump is embodied as a pump/nozzle and the fuel injection quantity is determined by means of a hydraulically driven control slide inserted in an overflow channel. This control slide determines the effective supply stroke and develops the fuel injection quantity of the injection pump by means of blocking the return flow out of the pump work chamber; and the injection is terminated when this control slide opens the overflow channel and the injection pressure can be relieved. In this known apparatus each control slide is actuated by the control pressure of a separate injection pump, acting as a control pump, which is driven simultaneously with the pump/nozzle. The control line acts as a filling line also, so that negative influences retroactively exerted on the fuel injection and control must be expected. A further disadvantage is that the fuel injection only takes place, in the inner-dead-center position of the pump piston, when the piston connects the control line with the pump work chamber through an annular groove. This limits its applicability in high speed engines. The object of the invention is to prevent the mutual influencing of supply and control pressure and to enhance the fuel injection and quantity metering so that the fuel injection apparatus will also be used in high-speed diesel engines.

OBJECTS AND SUMMARY OF THE INVENTION

It is an object of the invention to provide an improved fuel injection apparatus in which the fuel supply of the injection pump is enhanced while a sufficiently high control pressure of the control pressure line is maintained. The control pressure also enables a fast operation of the control slide. By adjusting the control pressure to about 30 to 80 bar and the supply pressure, for example, to about 6 bar, and by arranging the control line and filling pipe line separately, a precise and punctual fuel injection can be attained which can be also used in a high speed diesel engine. By separating the filling line and the control line the dead spaces which are closed during the injection period can be advantageously reduced in the pump work chamber as well as in the control line.

It is another object of the invention to enhance the fuel injection filling cycle by the provision of an additional inlet conduit.

It is still another object of the invention to provide a simplified system of filling lines and damping the pressure surges that appear in the control pressure pump during the gradual shutoff.

It is yet another objection of the invention that the overflow channel serves simultaneously to inject fuel into the pump work chamber and a related part of the filling chute is substituted and the guidance of the control slide is enhanced by using channels on the control slide.

It is a still further object of the invention to provide that the annular groove connecting the pressure chamber of the control slide with the discharge line ensures that the fuel leaving the pump work chamber under high pressure during the discharge does not enter the spring chamber of the control slide and negatively influence its control motion.

Still another object of the invention is to provide that if the fuel injection apparatus of the invention is equipped with a control distribution pump provided with a rotary distributor to determine the operation period of the control slide, the result is a fuel injection of the pump work chamber which is, in contrast to the state of the art, plainly separated from the precisely controllable operation of the control slide.

An even further object of the invention is to provide an hydraulic means to limit the stroke of the slide valve. Thus, the supply quantity of the injection pumps is advantageously and solely dependent on the operation period of the control slide and not on the supplied control quantity of fuel from the control pressure pump.

Yet another object of the invention is to provide that the slide valve gear make for a better control of discharge time achievable and that the line equipped with the throttle assures that the control slide always remains in its original position in non-activated condition, thus becoming unsusceptible to leakage.

A still further object of the invention is to provide good flow control and ventilation by use of a ring conduit.

The invention will be better understood and further objects thereof will become more apparent from the ensuing detailed description of 3 preferred embodiments taken in conjunction with the drawings.

DESCRIPTION OF THE PREFERRED EMBODIMENTS

Figure 1:
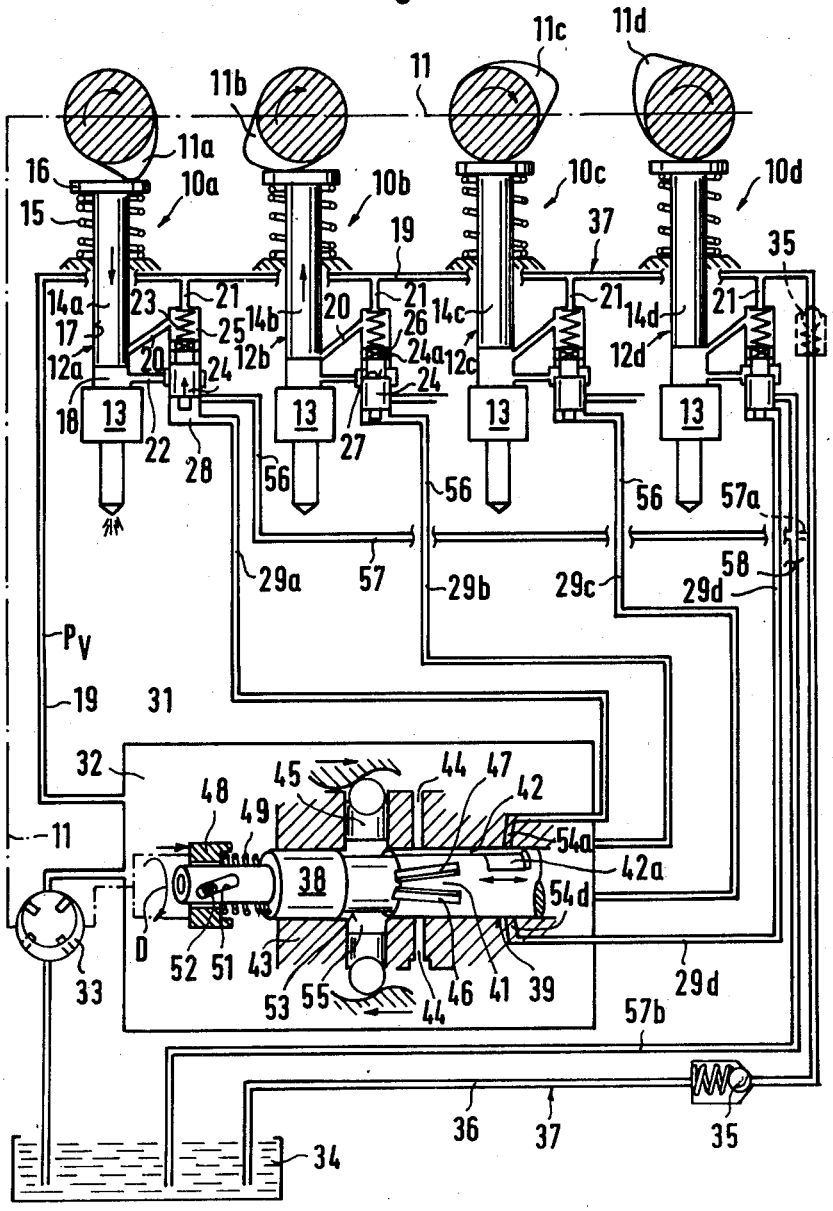
FIG. 1 is a simplified schematic representation of the first exemplary embodiment, having four injection pumps shown in cross section and embodied as pump-/nozzle and a control pressure pump shaped by a mechanical distribution pump.

In the fuel injection apparatus shown in FIG. 1, there are four mechanically driven pump/nozzle 10*a* to 10*d*, which are substantially made up of one injection pump 12*a* to 12*d*, embodied as a piston pump and driven by one drive cam 11*a* to 11*d* each of an engine camshaft 11, and one injection nozzle 13 combined therewith and embodied as a pressure-controlled injection valve. Any of the known injection valves which are controlled by fuel pressure and are embodied as a valve opening either inward or outward may be used as the injection nozzle 13, depending on the requirements of the engine. The pump pistons 14*a*, 14*b*, 14*c* and 14*d*, during their compression strokes which are generated counter to a push rod spring 15 by the drive cams 11*a* to 11*d* and are transmitted via roller push rods 16, dip into one each of the pump work chambers 18, embodied by a portion of a cylinder bore 17 of the pump pistons 14*a* to 14*d*. These pump work chambers 18 are filled with fuel via filling line 21 connected to supply line 19 which is common to all the pump/nozzles 10*a* to 10*d* and is under supply pressure $p_V$. These filling lines 21 are simultaneously also to be considered as extensions of the overflow channel 22 which are connected to the pump work chambers 18. Although in the illustrated embodiment additional inlet conduits 20, opened by the pump pistons 14*a* to 14*d* when the latter are in their inner dead-center positions, discharge into the pump work chamber 18, the overflow lines 22 are simultaneously also to be considered as a portion of the filling lines 21.

A control slide 24 actuable counter to the force of a restoring spring 23 is inserted into the connection of each overflow channel 22 with the filling line 21. In the case of the pump/nozzle 10*a*, the control slide 24 is in a position which closes the overflow channel 22 in order to initiate the injection; in the case of the other pump-/nozzles 10*b* to 10*d*, however, the control slide 24, in its outset position connecting the pump work chamber 18 with the filling line 21 and thus with the supply line 19 which serves as a low-pressure line, rests on a stop which is not shown in detail. In order to simplify the filling of the lines, the filling lines 21 each discharge into a spring chamber 25 of the control slide 24 containing the restoring spring 23, and the spring chamber 25 is in permanent connection, via channels 26 formed by faces or grooves in a section 24*a* of the control slide 24, with a control location 27 of the control slide 24 which is embodied as an annular groove. In the outset position of the control slide 24 shown in connection with the pump/nozzle 10*b* to 10*d*, the annular groove 27 has opened the connection from the filling line 21 to the overflow channel 22; in the case of the first pump/nozzle 10*a*, this connection is closed.

Each of the control slides 24 is limited on its end opposite the restoring spring 23 by a pressure chamber 28, which in turn is connected via a control line 29 to a control pressure pump 31 which is connected to all the pump/nozzles.

The control lines 29*a* to 29*d* are alternately placed under a control pressure $p_S$ by the control pressure pump 31 in rhythm with the injections when the fuel is pumped into the respective control line 29 by the control pressure pump 31. The fuel is pumped out of a tank 34 into an inner chamber 32 of the control pressure pump 31 by a supply pump 33 and is placed under pressure $p_V$. In order to regulate the supply pressure $p_V$ a pressure limitation valve 35 is coupled to the supply line 19 behind the last pump/nozzle 10*d*. Excess fuel is returned to the tank 34 via a return pipe 36 by way of valve 35. The supply line 19 and the return pipe 36 form a ring conduit 37 emanating from and returning to the tank 34, through which the control pressure pump 31 and the pump/nozzle 10 assure a continuous flow. Thus, an enhanced fuel injection, a cooling of the fuel supply and the disposal of emerging air bubbles is achieved.

The fuel supply of the entire fuel injection apparatus is embodied by the supply pump 33 and the pressure limitation valve 35, preferably embodied in turn as a constant quantity pump, and the control pressure $p_S$ created by the control pressure pump 31 is several times higher than the supply pressure $p_V$ which prevails in the supply line 19 and the filling lines 21. Favorable values for these pressures are approximately $p_V=6$ bar and $p_S=30$ to 80 bar.

The control pressure pump 31, comprised of a radial piston distributor pump, which is central to all pump-/nozzles 10, includes a rotary distributor 38, which is simultaneously activated with the supply pump 33 by the engine camshaft 11 in synchronization with the injection pumps 12*a*–12*d*. The distributor 38 can be displaced lengthwise to affect the supply quantity and can be turned relative to its drive motor to affect the discharge initiation. As may be seen from the simplified representation of FIG. 1 the revolving rotary distributor 38 is provided with a control surface 41 and a distributor groove 42 on its surface 39, and a housing 43 of the control pressure pump 31 contains a control bore 44 for each control line 29 to be controlled. Only two of these control bores 44 situated in the sectional plane are shown. The control bores 44 are closed by the control surface 41 on the rotary distributor 38 to determine the injection time. To change the injection time the control surface 41 is defined by two longitudinal grooves 46 and 47. The first of these grooves 46 is normally aligned in the direction of the longitudinal axis of the rotary distributor, whereas the second groove 47 is disposed in the surface 39 inclined at an angle to the longitudinal axis. Thus a varying control time is defined according to the position of the rotary distributor which, in turn, defines the injection quantity. If the first longitudinal groove 46 is disposed as shown, then it controls a load dependent change at the start of the injection. A change of the start of the injection dependent on rotational speed (rpm) is achieved by shifting an adjustment sleeve 48, which is driven by the camshaft 11, parallel to the axis of the rotary distributor against the force of a spray adjusting spring 49. This causes torsion of the rotary distributor relative to the drive motor by means of a bolt 52 which extends through an inclined slot 51 in the rotary distributor. The longitudinal shifting of the adjustment sleeve 48 can take place by known means such as fly weights as well as by electric control elements. The grooves 42, 46 and 47 connect to an annular groove 53 on the rotary distributor 38. Together with the distributor they comprise a pump work chamber 55 that is placed under pressure by a pump piston 45. The distributor groove 42 is provided with an enlargement 42 in the area of the point of discharge of the control lines 29*a* to 29*d*. Of these the discharge points 54*a* and 54*d* are shown, which keep the connection from the pump work chamber via the distribution groove 42 to the control lines 29*a*–29*d* open during the longest possible injection period and in any axial position of the rotary distributor 38.

To define the slide stroke of the control slide 24 and thus to prevent, mainly during lengthly injection periods, an overshot of the control slide 24, discharge lines 56 are connected laterally to the wall of the pressure chambers 28, which are lead to the tank 34 via a mutual interconnecting return pipe 57. If the pressure limitation valve 35 is disposed directly behind the last pump/nozzle 10*d*, as shown by dot-dash lines, then the return pipe 57 can discharge into the return pipe 36 joined to the supply line 19, as illustrated at 57*a*. The section of the return pipe 57 designated as 57*b* can then be discarded, as indicated by line 58.

In the further exemplary embodiments described in connection with FIGS. 2 to 4, identical elements or elements having the same function are given identical reference numerals; elements which are structurally modified are given a prime, and new elements are given new reference numerals.

Figure 2:
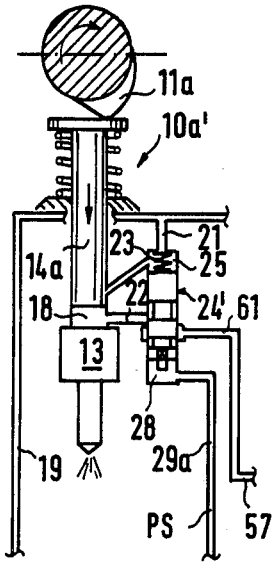
FIG. 2 is a schematic detailed view of the second exemplary embodiment, having a variation to the control slide used in FIG. 1 in that the filling pipe line is separated from the discharge line.
Figure 3:
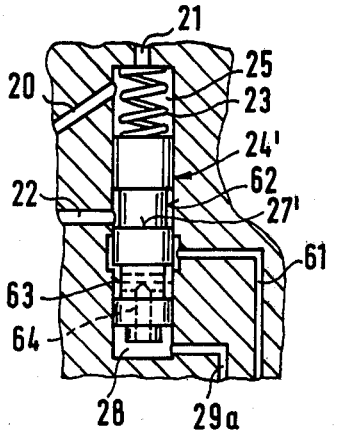
FIG. 3 shows an enlarged detailed view of the control slide used in FIG. 2.

In the second exemplary embodiment shown only as a partial view in FIG. 2 the pump/nozzles are constructed in the same fashion as those described for FIG.

1 of the first exemplary embodiment, and the control pressure pump 31 also functions in the same way. This exemplary embodiment shows a pump/nozzle 10*a*', that differs from the pump/nozzle 10*a* described in FIG. 1 only in that a control slide 24' is modified, as is shown in FIG. 3 in an enlarged scale. The control slide 24' includes a sealed annular groove 62 opposite the spring chamber 25 containing the restoring spring 23. The overflow channel 22 can be connected with a discharge line 61 via the annular groove 62, which comprises the control location 27', to terminate the injection in the starting position of the control slide 24'. In the shown position—the control slide 24' is regulating an injection—the connection from the overflow channel 22 to the discharge line 61 is closed, so that the fuel is pumped out of the pump work chamber 18 to the injection valve 13 which injects it into the motor cylinder during the downward motion of the pump piston 14*a*, as indicated by an arrow in FIG. 2. In this position the pressure chamber 28 of the control slide 24' is submitted to the control pressure $p_S$ in the control line 29*a*. In the shown operating position of the control slide 24' the pressure chamber 28 is connected to the discharge line 61 via a channel 64 drilled through the control slide 24'. Thus this discharge line 61 serves to define the control slide stroke, as does the discharge line 56 in FIG. 1. If the control slide 24' is returned to its starting position, not shown, by the force of the restoring spring 23 while the control line is discharged, then the overflow channel 22 is connected to the discharge line 61 and the injection is terminated. This positioning of the channels has the advantage that the shutoff surges do not obstruct the fuel filling of the pump work chamber 18. In this case the filling takes place exclusively via the inlet conduit 20. The discharge lines 61 are connected to the mutual return pipe 57, as are the corresponding lines 56 in FIG. 1.

Figure 4:
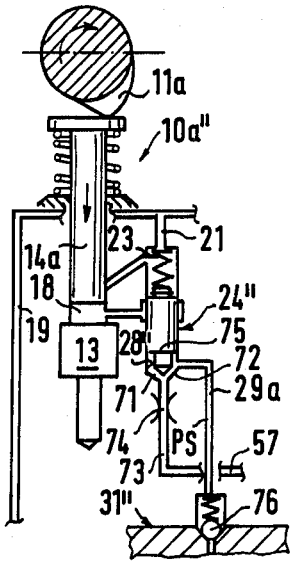
FIG. 4 shows a pump/nozzle of the third preferred embodiment with a modified control slide.

In the third exemplary embodiment, shown in FIG. 4, also shows only a partial view and the difference between this pump/nozzle 10*a*'' and the pump/nozzle shown in FIG. 1 is the modified execution and the control of the control slide 24''. The control slide 24'' is embodied like a pressure controlled needle valve of an internally opening injection valve and supports a valve cone 71 on its end remote from the restoring spring 23. The valve cone 71 communicates with a valve seat 72 at the discharge point of a discharge line 73 which is closed in the resting position of the control slide 24''. The discharge line 73 is provided with a flow throttle 74 and discharges into a return pipe 57 that interconnects all of the discharge lines 73 and leads back to the tank. The control line 29*a*, which can be subjected to pressure $p_S$, discharges radially into the pressure chamber 28'' and the control pressure engages a pressure shoulder 75, comprised of an area supporting one of the valve cones 71 of the control slide 24'', to actuate the control slide 24''. Retarded by the flow throttle 74 the control fuel quantity can thus flow back to the return pipe 57, and the discharge line 73 ensures, even if the control line 29*a* is discharged, that fuel under pressure seeping past the control slide 24'' does not enhance the fuel quantity unintentionally. In this position the control pressure pump 31'' can be provided with a pressure valve 76 at each pump outlet as is usual with injection pumps.

The operation of the fuel injection apparatus according to the invention is described in the following using the exemplary embodiment as shown in FIG. 1:

If the control surface 41 on the rotary distributor 38 closes the control bore 44 assigned to the control line 29*a*, the control pressure $p_S$ is built up by the control pressure pump 31 and is fed to the pressure chamber 28 of the first pump/nozzle 10*a* via the control line 29*a*. FIG. 1 shows the starting position of the injection for the first pump/nozzle 10*a*, as the fuel in the pump work chamber 18 is prevented from flowing out into the supply line 19 by the control slide 24 blocking the overflow channel 22. Following further downward stroke of the pump piston 14*a* the compressed fuel in the pump work chamber 18 is injected into the proper motor cylinder via the injection valve 13. The other unactuated pump/nozzles 10*b* to 10*d* are without pressure either during the upward stroke or in the inner dead-center position of the proper pump pistons 14*b* to 14*d* and the control slides are in the corresponding resting position.

If there is a further rotary movement of the rotary distributor 38 in the clockwise direction as shown by arrow D, then the control line 29*a* is discharged into the inner chamber 32 of the control pressure pump 31 via the distributor groove 42, the annular groove 53, and the longitudinal groove 47 on the rotary distributor 38 so as to control the termination of the injection when the control surface 41 no longer closes the control bores 44. This reduces the pressure in the control line 29*a* to the supply pressure $p_V$ prevailing in the supply line 19 and the pressure in the pressure chamber 28 of the first pump/nozzle 10*a* is lowered, thereby enabling the restoring spring 23 to shift the control slide 29*a* into its starting position. This connects the pump work chamber 18 with the supply line 19 via the overflow channel 22, the control location 27 on the control slide 24, the channels 26, the spring chamber 25, and the filling line 21. The drop in pressure caused by this in the pump work chamber 18 terminates the injection and a standing pressure corresponding to the supply pressure $p_V$ only is maintained. By the end of the residual stroke of the pump piston 14*a* the surplus fuel is driven out of the pump work chamber 18 into the supply line 19, and during the following suction stroke this pump work chamber 18 is filled again via the filling line 21 and the overflow channel 22. This fuel filling is assisted by the inlet conduits 20 shortly before the pump piston 14*a* reaches its inner dead-center position and is terminated when the pump piston 14*a* rests in its inner dead-center position as is the case with the pump pistons 14*c* and 14*d* of the third and fourth pump/nozzles 10*c* and 10*d*.

The drive cams 11*a* to 11*d* are embodied such, that a longer stay of the pump pistons 14*a* and 14*d* takes place in the inner dead-center position, which assures a sufficient filling time.

In the exemplary embodiment shown the individual pump/nozzles 10*a* to 10*d* are directly actuated by the driving cams 11*a* to 11*d*. The driving cams 11*a* to 11*d* are actuated and connected by the camshaft 11 shown by the dot dashed line, preferably embodied by the overhead engine camshaft, which assures the "rigid drive" necessary to create high injection pressures. Naturally, the pump pistons 14*a* and 14*d* can also be actuated by the drive cams 11*a* to 11*d* via basically known rocker arms, not shown. In an advantageous embodiment the control pressure pump 31 is also actuated by the same engine camshaft 11 and a favorable spatial positioning of the entire fuel injection apparatus results if it is actuated by the engine camshaft 11, too, as depicted by a dot dash line at the supply pump 33.

The fuel injection apparatuses described as exemplary embodiments are provided with pump/nozzles exclusively, because with such pump/nozzle units the advantages of the hydraulic control according to the invention are best attained. However, the principal of the invention can also be applied with single pumps and with injection pumps which are combined to make series-type pumps.

The foregoing relates to preferred exemplary embodiments of the invention, it being understood that other embodiments and variants thereof are possible within the spirit and scope of the invention, the latter being defined by the appended claim.

What is claimed and desired to be secured by Letters Patent of the United States is:

1. A fuel injection apparatus for diesel-type internal combustion engines, having one mechanically driven pump piston of an injection pump per engine cylinder combined with an injection nozzle into a pump/nozzle, each said apparatus having one control slide hydraulically actuatable counter to a force of at least one restoring spring in a restoring spring chamber, said control slide defining a pressure chamber and being inserted into an overflow channel in permanent communication with a pump work chamber, each said apparatus having a control line through which control pressure from at least one pump work chamber of a control pressure pump which is common to all said injection pumps can be fed to or relieved from said pressure chamber of the respective control slide, said control slide arranged to close said overflow channel in order to initiate the onset of injection with the control pressure fed to the pressure chamber and further arranged to open again in order to terminate injection with relieved control pressure in the pressure chamber, and further including a supply pump which supplies said control pressure pump as well as the injection pump via a supply line with fuel from a tank, said supply pump which supplies said control pressure pump with fuel under a supply pressure ($p_V$) is arranged to be connected to said pump work chambers of said injection pumps via filling lines separate from each said control line, and further each said filling line is connected to said spring restoring chamber and to said pump work chamber via an inlet conduit which is disposed in the wall of the pump work chamber and further said inlet conduits are controlled by said pump pistons, characterized in that said filling lines are connected with said supply pump via said supply line which is common to all said injection pumps, and said common supply line being under said supply pressure ($p_V$) and arranged to bypass the said pump work chamber of said control pressure pump, and further wherein each said control line is separated over its whole length from the said supply line as well as from said filling lines and said inlet conduits.

2. A fuel injection apparatus as defined by claim 1, characterized in that said pump work chamber can be connected with said filling line via said overflow channel controlled by a control location on said control slide.

3. A fuel injection apparatus as defined by claim 2, characterized in that each said filling line can be connected to said overflow channel via at least one channel between said control location on said control slide and a zone section on said control slide that is disposed in proximity to said restoring spring chamber.

4. A fuel injection apparatus as defined by claim 1, characterized in that said overflow channel is connected to a discharge line via a sealed annular groove provided on each said control slide, said discharge line being connected to a common return line.

5. A fuel injection apparatus as defined by claim 4 characterized in that said discharge line communicates with said pressure chamber defined by said control slide, said pressure chamber connected to means defining an opening which leads to another annular groove in said control slide, whereby the stroke of said control slide can be delineated.

6. A fuel injection apparatus as defined by claim 1, further characterized in that a distributor pump forms the control pressure pump including a rotary distributor which is driven in synchronism with said injection pumps said distributor being longitudinally displaced to alter fuel supply quantity and rotated relative to a drive motor to alter the onset of said injection, and further that said rotary distributor includes a distributor groove and a control surface on a surface thereof, said control surface providing for connection of said pump work chamber and said control line via said distributor groove to said low pressure line in synchronization with said injections to control said control pressure ($p_S$) which actuates said control slides.

7. A fuel injection apparatus as defined by claim 1, characterized in that each said control slide further includes a pressure shoulder and a valve cone, said valve cone arranged to seal a channel in said pressure chamber, further wherein said control line discharges radially into said pressure chamber in proximity to said pressure shoulder and said valve cone is arranged to close a discharge line provided with a flow throttle, said discharge line connected to a common return pipe.

8. A fuel injection apparatus as defined by claim 1, characterized in that said supply line is connected, behind the last injection pump, to a return pipe which leads to a fuel tank via a pressure limitation valve.

* * * * *